US007661166B1

(12) United States Patent
Marling et al.

(10) Patent No.: US 7,661,166 B1
(45) Date of Patent: Feb. 16, 2010

(54) ADJUSTABLE FIRMNESS MATTRESS ASSEMBLY

(75) Inventors: Randy M. Marling, O'Fallon, IL (US); Larry Bourneuf, St. Louis, MO (US)

(73) Assignee: Fredman Bros. Furniture Company, Inc., St. Louis, MO (US)

( * ) Notice: Subject to any disclaimer, the term of this patent is extended or adjusted under 35 U.S.C. 154(b) by 0 days.

(21) Appl. No.: 12/284,160

(22) Filed: Sep. 18, 2008

(51) Int. Cl.
*A47C 27/15* (2006.01)
*A47C 27/00* (2006.01)

(52) U.S. Cl. ..... 5/738; 5/727; 5/691; 5/925

(58) Field of Classification Search ..... 5/738, 5/691, 727, 690, 740, 925
See application file for complete search history.

(56) References Cited

U.S. PATENT DOCUMENTS

| | | | | | |
|---|---|---|---|---|---|
| 1,528,066 | A | * | 3/1925 | McEntire | 5/722 |
| 3,521,311 | A | | 7/1970 | Cohen | |
| 3,534,417 | A | | 10/1970 | Boyles | |
| 3,950,798 | A | * | 4/1976 | Borsini | 5/722 |
| 4,424,600 | A | * | 1/1984 | Callaway | 5/710 |
| 4,449,261 | A | | 5/1984 | Magnusson | |
| 4,476,594 | A | | 10/1984 | McLeod | |
| 4,706,313 | A | | 11/1987 | Murphy | |
| RE32,734 | E | | 8/1988 | McLeod | |
| 4,955,095 | A | * | 9/1990 | Gerrick | 5/691 |
| 5,231,717 | A | | 8/1993 | Scott et al. | |
| 5,488,746 | A | * | 2/1996 | Hudson | 5/500 |
| 5,557,813 | A | * | 9/1996 | Steed et al. | 5/739 |
| 5,953,779 | A | | 9/1999 | Schwartz | |
| 5,960,496 | A | | 10/1999 | Boyd | |
| 6,016,582 | A | * | 1/2000 | Larson | 5/691 |
| 6,088,858 | A | * | 7/2000 | Juster et al. | 5/737 |
| 6,115,861 | A | | 9/2000 | Reeder et al. | |
| 6,223,371 | B1 | | 5/2001 | Antinori et al. | |
| 6,256,821 | B1 | | 7/2001 | Boyd | |
| 7,155,765 | B2 | | 1/2007 | Fogg | |
| 7,191,483 | B2 | | 3/2007 | Hochschild | |
| 7,386,903 | B2 | | 6/2008 | Hochschild | |
| 2006/0096034 | A1 | | 5/2006 | Tucci | |

* cited by examiner

*Primary Examiner*—Alexander Grosz
(74) *Attorney, Agent, or Firm*—David H. Chervitz

(57) ABSTRACT

An adjustable firmness mattress assembly is disclosed which comprises a duvet, a first section of foam material having a top surface and a bottom surface with the surfaces capable of supporting a user, a second section of foam material having a top surface and a bottom surface with the surfaces capable of supporting a user, and a cover for enclosing the first and second sections with the cover having a top surface and the duvet adapted for being positioned on the top surface of the cover.

18 Claims, 3 Drawing Sheets

ADJUSTABLE FIRMNESS MATTRESS ASSEMBLY

BACKGROUND OF THE DISCLOSURE

This invention relates to mattresses and more particularly to an adjustable firmness mattress assembly.

Conventional beds may consist of a mattress, a box spring, a headboard, a footboard, and a bed frame for supporting the mattress and the box spring. The mattress can take on various forms and constructions such as springs, foam, memory foam, air, or water. For example, a standard mattress includes a plurality of metal springs or coils sandwiched between a pair of pads. A cloth cover is used to encase the springs and pads. Over time the mattress may be turned over when one side becomes worn out or depressed due to wear and use. Other than repair or replace there is no other way to adjust the mattress. A foam mattress may include one or more layers of foam assembled encased within a fabric cover to resemble a standard spring mattress. Again, other than reversing the foam mattress or removing or replacing the foam layers there is no other way to adjust the foam mattress. Memory foam is made from polyurethane and is often referred to as visco-elastic polyurethane foam. Memory foam if firmer in cool temperatures and softer when warm. Higher density memory foam reacts to body heat that allows it to mold itself to the shape of warm body within a few minutes. Lower density memory foam is pressure sensitive and will mold more quickly to the shape of the body. Memory foam is heavier than a foam mattress and more expensive. Also, memory foam mattresses do not provide any ability to adjust various portions of the mattress. An air mattress typically contains one or more air chambers that are filled with air. Some known air mattresses have two chambers on each side of the bed and allow a user to adjust each side to various amounts of firmness. However, the adjustment is limited to the entire length of the air mattress and no provision is available for adjusting various areas under a body. A waterbed can consist of one or more bladders or chambers filled with water. However, once filled the bed is either not adjustable or very difficult to adjust.

Some mattress constructions have been proposed that include various foam members that are reversible for presenting a firm side or a soft side to a user. However, such mattress constructions do not provide an upper layer or portion that simulates a particular mattress construction or allows for adjustment of the upper layer. For example, some individuals may prefer an air mattress, but present mattress constructions, which include reversible foam members, have no provision for having an air mattress as the upper layer upon which an individual rests. By way of further example, some individuals prefer a mattress consisting of metal springs and coils. However, none of the prior mattress constructions allow for a mattress having foam members and an upper layer consisting of metal springs and coils. It would be advantageous to have an adjustable firmness mattress assembly or system that can provide various upper layers to suit the needs or requirements of an individual.

The present adjustable firmness mattress assembly is designed to obviate and overcome many of the disadvantages and shortcomings associated with prior mattresses. Further, the present adjustable firmness mattress assembly provides an upper layer or duvet that simulates a particular mattress construction and is adjustable. In particular, the present adjustable firmness mattress assembly provides adjustable firmness control for the consumer who purchases the assembly. Moreover, the present adjustable firmness mattress assembly provides adjustable firmness control for each user of the assembly. The adjustable firmness mattress assembly is applicable for use with any sized bed such as twin, full, queen, kings, and California king size beds.

SUMMARY OF THE DISCLOSURE

In one form of the present disclosure, an adjustable firmness mattress assembly is disclosed which comprises a duvet, a first section of foam material having a top surface and a bottom surface with the surfaces capable of supporting a user, a second section of foam material having a top surface and a bottom surface with the surfaces capable of supporting a user, and a cover for enclosing the first and second sections with the cover having a top surface and the duvet adapted for being positioned on the top surface of the cover.

In another form of the present disclosure, an adjustable firmness mattress system comprises a duvet, a first section comprising a first portion of foam material having a top surface and a bottom surface, a second portion of foam material having a top surface and a bottom surface, and a third portion of foam material having a top surface and a bottom surface with the first portion capable of supporting a head portion of a user, the second portion capable of supporting a middle portion of a user, and the third portion capable of supporting a foot portion of a user, a second section comprising a first portion of foam material having a top surface and a bottom surface, a second portion of foam material having a top surface and a bottom surface, and a third portion of foam material having a top surface and a bottom surface with the first portion capable of supporting a head portion of a user, the second portion capable of supporting a middle portion of a user, and a third portion capable of supporting a foot portion of a user, and a cover for enclosing the first and second sections with the cover having a top surface and the duvet is adapted for being placed upon the top surface of the cover.

In yet another form of the present disclosure, a method for adjusting mattress firmness is disclosed which comprises the steps of providing a duvet, providing a first section of foam material having a top surface and a bottom surface with the surfaces capable of supporting a user with the top surface having a first firmness and the bottom surface having a second firmness with the first firmness being different than the second firmness, providing a second section of foam material having a top surface and a bottom surface with the surfaces capable of supporting a user with the top surface having a first firmness and the bottom surface having a second firmness with the first firmness being different than the second firmness, and providing a cover for enclosing the first and second sections with the cover having a top surface and the duvet adapted for being positioned on the top surface of the cover.

In light of the foregoing comments, it will be recognized that the present disclosure provides an adjustable firmness mattress assembly that is of simple construction and design and which can be easily employed with highly reliable results.

The present disclosure also provides an adjustable firmness mattress assembly that employs lightweight structures or components.

The present disclosure further provides an adjustable firmness mattress assembly that can be shipped in a compact form and container.

These and other objects and advantages of the present disclosure will become apparent after considering the following detailed specification in conjunction with the accompanying drawings, wherein

DETAILED DESCRIPTION OF THE EMBODIMENTS

Figure 1:
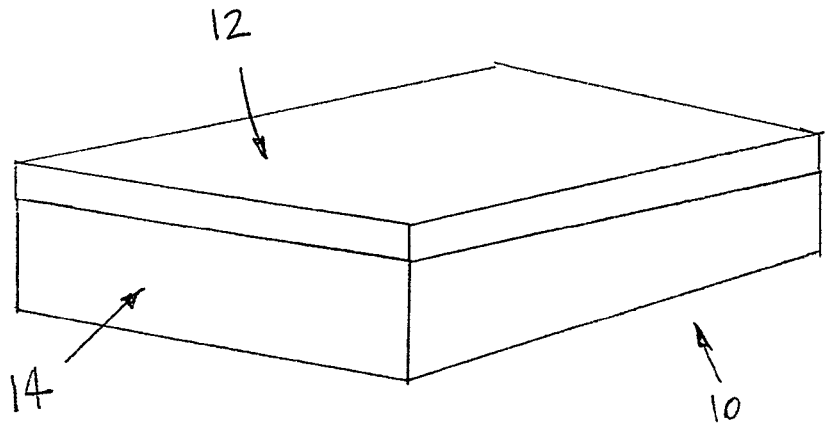
FIG. 1 is a perspective view of an embodiment of an adjustable firmness mattress assembly constructed according to the present disclosure.

Referring now to the drawings, wherein like numbers refer to like items, number 10 identifies an embodiment of an adjustable firmness mattress assembly constructed according mattress 10 is shown comprising a duvet 12 that is adapted to be placed or positioned over a base portion 14. The duvet 12 is not attached to the base portion 14 and may be easily moved or repositioned on the base portion 14. For example, over time the duvet 12 may wear in certain areas and in order to adjust the wear patterns the duvet 12 may be repositioned by moving the head end of the foot end of the assembly 10. The duvet 12 may have a height of three inches, for example. However, other heights are possible and contemplated. Further, the height of the duvet 12 and the height of the base portion 14 may be constructed to simulate the height of a conventional mattress and conventional sheets may be used with the assembly 10. The duvet 12 may be a covered layer of foam, latex, memory foam, air chamber or chambers, water chamber or chambers, or metal springs and coils. Other interior constructions for the duvet 12 are also possible such as feathered or down.

Figure 2:
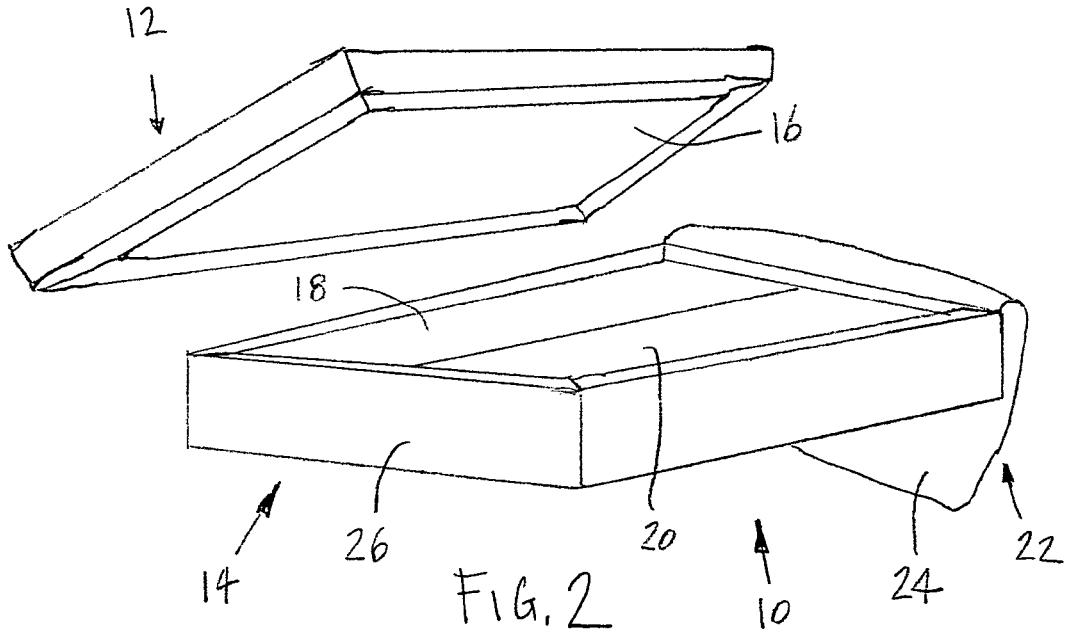
FIG. 2 is a perspective view of the adjustable firmness mattress assembly shown in FIG. 1 with the duvet removed and a top cover removed from a base portion.

FIG. 2 shows the duvet 12 being removed from the base portion 14. The duvet 12 has a bottom surface 16 that can include a non-woven no skid surface. It is also possible and contemplated that other structures may be used for holding or securing the duvet 12 in place on the base portion 14 such as hook and loop fastening means or snaps. The bottom surface 16 may include a zipper (not shown) for gaining access to the interior of the duvet 12. The base portion 14 has a first section 18 and a second section 20. The first section 18 and the second section 20 may be constructed of a foam material. The first section 18 extends the length of the base portion 14 and the second section 20 also extends the length of the base portion 14. In particular, one person can rest or sleep on the first section 18 and another person can rest or sleep on the second section 20. The base portion 14 includes a cover 22 that has a top surface 24. The cover 22 can include a zipper (not shown) for easily opening and closing the cover 22. The cover 22 may be opened to adjust the first section 18 and the second section 20, as will be discussed. The top surface 24 can include a non-woven no skid surface. When the bottom surface 16 of the duvet 12 is placed or positioned on the top surface 24 of the cover 22 the duvet 12 will be in frictional engagement with the base portion 14. As will be explained further herein, the first section 18 and the second section 20 are reversible for adjusting the firmness of the assembly 10. The base portion 14 may also include a casing 26 which is sized and shaped to house or contain the first section 18 and the second section 20.

Figure 3:
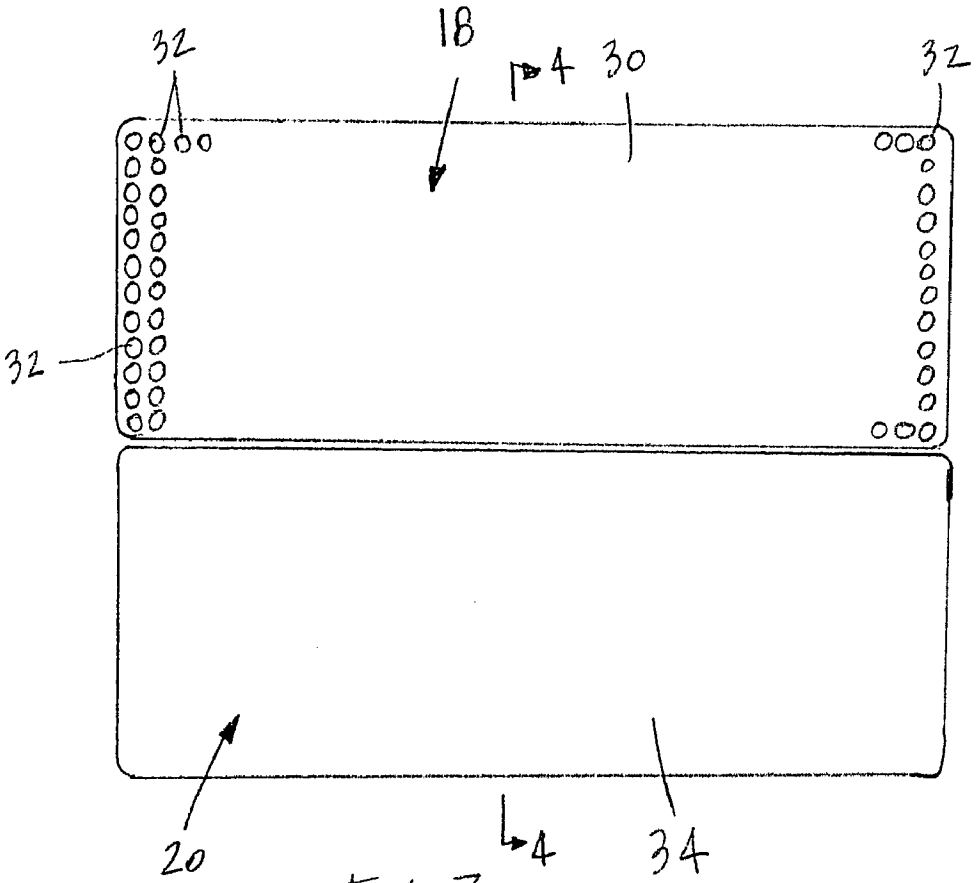
FIG. 3 is a top view of the first section and the second section of the adjustable firmness mattress assembly.

With reference now to FIG. 3, a top view of the first section 18 and the second section 20 is illustrated. The first section 18 has a textured or pattern top surface 30 which may consist of a series of convolutions 32 throughout the entire top surface 30. However, for the sake of brevity, only a few of the convolutions 32 are depicted in FIG. 3. The second section 20 comprises a top surface 34 that is relatively flat. The first section 18 is sized and shaped to extend the length of the assembly 10. The first section 18 is capable of supporting a top or head portion of a user, a middle or torso portion of a user, and a bottom or leg and feet portion of a user. The second section 20 is also sized and shaped to extend the length of the assembly 10. The second section 20 is also capable of supporting a top or head portion of a user, a middle or torso portion of a user, and a bottom or leg and feet portion of a user.

Figure 4:
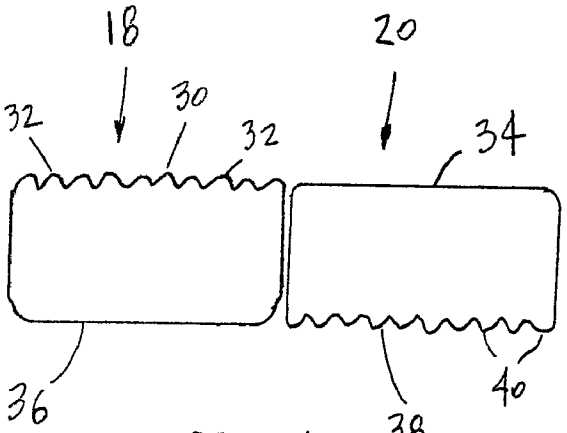
FIG. 4 is a cross-sectional view of the first section and the second section taken along the plane of line 4-4 of FIG. 3.

FIG. 4 shows a cross-sectional view of the first section 18 and the second section 20. The first section 18 has the top surface 30 having the series of convolutions 32. The first section 18 also has a bottom surface 36 that is relatively flat. The second section 20 has the top surface 34 and a bottom surface 38 having a series of convolutions 40. As can be appreciated, the first section 18 and the second section 20 are reversible. The first section 18 and the second section 20 may be composed of high-density foam or high resilience foam. The top surface 34 or the bottom surface 36 may have Indentation Load Deflection (ILD) values of for example 30 to 32 and this represents a firm side. The top surface 30 and the bottom surface 38 may have ILD values of for example 20 to 21 and this represents a soft side. The foam material may have a density of 1.8 pounds per cubic foot. These values are exemplary only and can be varied as required. In particular, if one side of the assembly 10 needs to be firm and the other side of the assembly 10 needs to be soft, then the bottom surface 36 of the first section 18 may be presented and the bottom surface 38 of the second section 20. If both sides of the assembly 10 need to be firm then the bottom surface 36 of the first section 18 and the top surface 34 of the second section 20 may be presented. Also, if both sides of the assembly 10 need to be soft then the top surface 30 of the first section 18 and the bottom surface 38 of the second section 20 will be presented. In this manner the firmness of the assembly 10 may be adjusted. Further, through the use of the convolutions 32 or 40 one section of foam material may be used to construct a section having a firm surface and a soft surface.

In operation, an individual can adjust the firmness of the assembly 10 by orientating the desired firmness surface of each of the sections 18 and 20. Also, the duvet 12 can be selected to suit the needs and requirements of an individual. For example, if an individual prefers a memory foam or foam type matters, a duvet 12 having an interior comprising a memory foam layer or foam may be placed on the top surface 24. If a duvet having a spring system is desired then a duvet 12 having an interior comprising a spring system may be selected and placed on the top surface 24. Also, if an air mattress is desired then a duvet 12 having an air type mattress in the interior of the duvet 12 will be placed on the top surface 24 of the cover 22.

Figure 5:
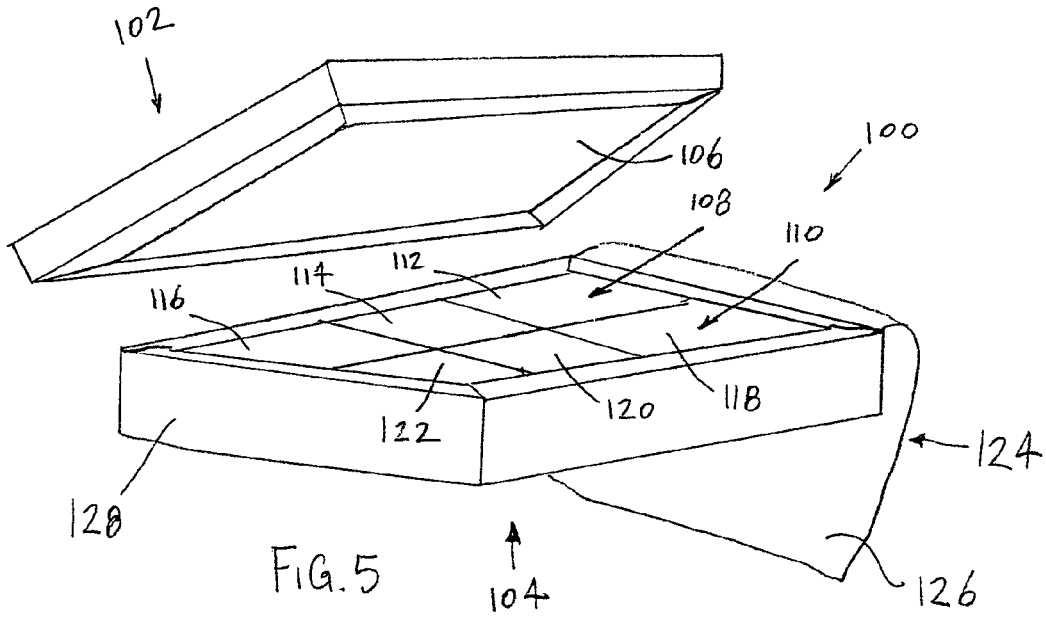
FIG. 5 is a perspective view of another embodiment of an adjustable firmness mattress assembly with a duvet removed and a top cover removed from a base portion.

With particular reference now to FIG. 5, another embodiment of an adjustable firmness mattress assembly 100 is shown. The assembly 100 comprises a duvet 102 and a base portion 104. The duvet 102 is adapted to placed or positioned over the base portion 104. The duvet 102 is not attached to the base portion 104 and may be easily moved or repositioned on the base portion 104. The duvet 102 has a bottom surface 106 that can include a non-woven no skid surface. The bottom surface 106 may include a zipper (not shown) for gaining access to the interior of the duvet 102. As previously indicated, the duvet 102 may be a covered layer of foam, latex, memory foam, air chamber or chambers, water chamber or chambers, or metal springs and coils. Other interior constructions for the duvet 102 are also possible such as feathered or down. Also, as previously discussed, the duvet 102 may be held or secured in place on the base portion by use of other structures such as hook and loop fastening means or snaps.

The base portion 104 has a first section 108 and a second section 110. The first section 108 comprises a first portion 112, a second portion 114, and a third portion 116. The first portion 112, the second portion 114, and the third portion 116 may be composed of high-density foam or high resilience foam. The first portion 112 is adapted to support a head of a user, the second portion 114 is adapted to support a torso or center section of a user, and the third portion 116 is adapted to support a leg and feet portion of a user. The second section 110 comprises a first portion 118, a second portion 120, and a third portion 122. The first portion 118, the second portion 120, and the third portion 122 may be composed of high-density foam or high resilience foam. The first portion 118 is adapted to support a head of a user, the second portion 120 is adapted to support a torso or center section of a user, and the third portion 122 is adapted to support a leg and feet portion of a user. The base portion 104 includes a cover 124 that has a top surface 126. The cover 124 can include a zipper (not shown) for easily opening and closing the cover 124. The cover 124 may be opened to adjust the portions 112, 114, 116, 118, 120, and 122, as will be discussed. The top surface 126 can include a non-woven no skid surface. When the bottom surface 106 of the duvet 102 is placed or positioned on the top surface 126 of the cover 124 the duvet 102 will be in frictional engagement with the base portion 104. The base portion 104 may also includes a casing 128 for housing or containing the first section 108 and the second section 110.

Figure 6:
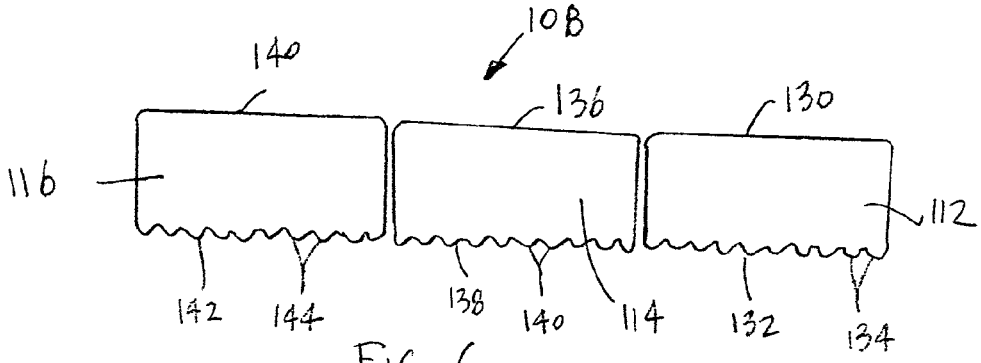
FIG. 6 is side perspective view of a first section of the adjustable firmness mattress assembly shown in FIG. 5.

FIG. 6 illustrates a side perspective view of the first section 108 removed from the assembly 100. The first section 108 has the first section 112 having a top surface 130 and a bottom surface 132 having a pattern such as convolutions 134. The second section 114 has a top surface 136 and a bottom surface 138 having convolutions 140. Also, the third section 116 has a top surface 140 and a bottom surface 142 having convolutions 144. As has been previously described, the top surfaces 130, 136, and 140 are for presenting a firm surface having ILD values of for example 30 to 32. The bottom surfaces 132, 138, and 142 are for presenting a soft surface having ILD values of for example 20 to 21. Although such ILD values have been shown by way of example, it is possible to have any required ILD values for the various surfaces. Positioning the desired firmness surface of the portions 112, 114, and 116 can adjust the first section 108 of the assembly 100. For example, if the head portion and the leg and feet portion need to be firm then the top surfaces 130 and 140 of the first portion 112 and the third portion 116 are presented upwardly and if the torso portion needs to be soft then the bottom surface 138 of the second portion 114 will be presented upwardly. As can be appreciated, the second section 110 comprises the portions 118, 120, and 122 which are similar in shape and design as the portions 112, 114, and 116. The portions 118, 120, and 122 can be adjusted in a similar manner to provide the desired firmness for the second section 110 of the assembly 100.

As can be realized, the adjustable firmness mattress assembly 10 is applicable for use with twin, full, queen, kings and California king size beds. The assembly 10 may be sized and shaped to be placed on pre-existing foundations or box springs. Also, the adjustable firmness mattress assembly 10 in combination with a foundation may be placed on a metal bed frame for supporting the assembly 10 and the foundation above the floor. The assembly 10 may be packaged in portions or sections so that the assembly 10 may be easily stored or transported.

From all that has been said, it will be clear that there has thus been shown and described herein an adjustable firmness mattress assembly which fulfills the various objects and advantages sought therefore. It will become apparent to those skilled in the art, however, that many changes, modifications, variations, and other uses and applications of the subject adjustable firmness mattress assembly are possible and contemplated. All changes, modifications, variations, and other uses and applications which do not depart from the spirit and scope of the are deemed to be covered by the subject adjustable firmness mattress assembly, which is limited only by the claims which follow.

What is claimed is:

1. An adjustable firmness mattress assembly comprising:

a first section of foam material having a top surface and a bottom surface with the surfaces capable of supporting a user, the top surface having a series of convolutions for forming a firm surface and the bottom surface having a flat surface for forming a soft surface;

a second section of foam material having a top surface and a bottom surface with the surfaces capable of supporting a user, the top surface having a flat surface for forming a soft surface and the bottom side having a series of convolutions for forming a firm surface;

a cover for enclosing the first and second sections with the cover having a top surface; and a duvet having a bottom surface having a non-woven no skid surface in frictional engagement with the top surface of the cover and the duvet not being attached to the cover and being repositionable on the cover.

2. The adjustable firmness mattress assembly of claim 1 wherein the top surface of the first section has an indentation load deflection value of 30 to 32.

3. The adjustable firmness mattress assembly of claim 2 wherein the bottom surface of the first section has an indentation load deflection value of 20 to 21.

4. The adjustable firmness mattress assembly of claim 1 wherein the top surface of the second section has an indentation load deflection value of 20 to 21.

5. The adjustable firmness mattress assembly of claim 4 wherein the bottom surface of the second section has an indentation load deflection value of 30 to 32.

6. The adjustable firmness mattress assembly of claim 1 wherein the duvet comprises a foam material.

7. The adjustable firmness mattress assembly of claim 1 wherein the top surface of the cover has a non-woven no skid surface in frictional engagement with the bottom surface of the duvet.

8. The adjustable firmness mattress assembly of claim 1 wherein the first section of foam material has a density of 1.8 pounds per cubic foot.

9. The adjustable firmness mattress system comprising:

a base portion comprising a first section comprising a first portion of foam material having a top surface and a bottom surface, the top surface having a series of convolutions forming a firm surface and the bottom surface having a flat surface forming a soft surface, a second portion of foam material having a top surface and a bottom surface, the top surface having a series of convolutions forming a firm surface and the bottom surface having a flat surface forming a soft surface, and a third portion of foam material having a top surface and a bottom surface, the top surface having a series of convolutions forming a firm surface and the bottom surface having a flat surface forming a soft surface with the first portion capable of supporting a head portion of a user, the second portion capable of supporting a middle portion of a user, and the third portion capable of supporting a foot portion of a user;

a second section comprising a first portion of foam material having a top surface and a bottom surface, the top surface having a series of convolutions forming a firm surface and the bottom surface having a flat surface forming a soft surface, a second portion of foam material having a top surface and a bottom surface, the top surface having a series of convolutions forming a firm surface and the bottom surface having a flat surface forming a soft surface, and a third portion of foam material having a top surface and a bottom surface, the top surface having a series of convolutions forming a firm surface and the bottom surface having a flat surface forming a soft surface with the first portion capable of supporting a head portion of a user, the second portion capable of supporting a middle portion of a user, and the third portion capable of supporting a foot portion of a user;

a cover for enclosing the first and second sections with the cover having a top surface; and a duvet having a bottom surface having a non-woven no skid surface in frictional engagement with the top surface of the cover and the duvet not being attached to the cover and being repositionable on the cover.

10. The adjustable firmness mattress system of claim 9 wherein the top surface of the first portion of the first section has an indentation load deflection value of 30 to 32 and the bottom surface of the first portion of the first section has an indentation load deflection value of 20 to 21.

11. The adjustable firmness mattress system of claim 9 wherein the top surface of the first portion of the second section has an indentation load deflection value of 30 to 32 and the bottom surface of the first portion of the second section has an indentation load deflection value of 20 to 21.

12. The adjustable firmness mattress system of claim 9 wherein the duvet comprises a foam material.

13. The adjustable firmness mattress system of claim 9 wherein the duvet comprises a spring system.

14. The adjustable firmness mattress system of claim 9 wherein the duvet comprises an air system.

15. The adjustable firmness mattress system of claim 9 wherein the first portion of foam material of the first section has a density of 1.8 pounds per cubic f.

16. The adjustable firmness mattress system of claim 9 wherein the top surface of the cover has a non-woven no skid surface in frictional engagement with the bottom surface of the duvet.

17. A method for adjusting mattress firmness comprising the steps of providing a first section of foam material having a top surface and a bottom surface with the surfaces capable of supporting a user with the top surface having a series of convolutions for forming a firm surface and the bottom surface having a flat surface for forming a soft surface, providing a second section of foam material having a top surface and a bottom surface with the surfaces capable of supporting a user with the top surface having a flat surface for forming a soft surface and the bottom surface having a series of convolutions for forming a firm surface, providing a cover for enclosing the first and second sections with the cover having a top surface and providing a duvet having a bottom surface having a non-woven no skid surface in frictional engagement with the top surface of the cover and the duvet not being attached to the cover and being repositionable on the cover.

18. The method of claim 17 further comprising the step of providing the top surface of the cover with a non-woven no skid surface in frictional engagement with the bottom surface of the duvet.

* * * * *

UNITED STATES PATENT AND TRADEMARK OFFICE

CERTIFICATE OF CORRECTION

PATENT NO. : 7,661,166 B1
APPLICATION NO. : 12/284160
DATED : February 16, 2010
INVENTOR(S) : Randy M. Marling and Larry Bourneuf It is certified that error appears in the above-identified patent and that said Letters Patent is hereby corrected as shown below:

Column 1, line 24, "if" should be --is--;

Column 3, line 29, after "according" add --to the present disclosure. With reference now to FIG. 1, the adjustable firmness--; line 36, the first occurrence of "of" should be --to--;

Column 4, line 56, "matters" should be --mattress--;

Column 5, line 40, "includes" should be --include--;

Column 6, line 20, after the first occurrence of "the" add --disclosure--;

Column 6, Claim 1, line 10, "side" should be --surface--;

Column 6, Claim 9, line 1, "The" should be --An--; and

Column 8, Claim 15, line 3, "f" should be --foot--.

Signed and Sealed this

Sixth Day of April, 2010

David J. Kappos

David J. Kappos
*Director of the United States Patent and Trademark Office*